US008381838B2

(12) United States Patent
Hutniak et al.

(10) Patent No.: US 8,381,838 B2
(45) Date of Patent: Feb. 26, 2013

(54) SYSTEM AND APPARATUS FOR DIRECTING THE DRILLING OF A WELL

(75) Inventors: Nicholas Hutniak, Calgary (CA); Sergey Khromov, Calgary (CA); Aaron Eddy, Calgary (CA); Robert Rodda, Calgary (CA); Wes Hansen, Calgary (CA)

(73) Assignee: Pason Systems Corp. (CA)

( * ) Notice: Subject to any disclaimer, the term of this patent is extended or adjusted under 35 U.S.C. 154(b) by 351 days.

(21) Appl. No.: 12/650,842

(22) Filed: Dec. 31, 2009

(65) Prior Publication Data

US 2011/0155461 A1 Jun. 30, 2011

(51) Int. Cl.
*E21B 44/00* (2006.01)
*E21B 47/00* (2006.01)
*G01V 3/00* (2006.01)

(52) U.S. Cl. ..... 175/61; 175/24; 175/45; 166/66; 340/853.3; 367/81

(58) Field of Classification Search ..... 175/24, 175/40, 45, 61; 166/66; 702/5, 6, 9, 45; 340/853.3, 853.1, 853.014, 853.02, 870.01; 367/81–87

See application file for complete search history.

(56) References Cited

U.S. PATENT DOCUMENTS 3,620,077 A 11/1971 Brown et al.
4,545,017 A * 10/1985 Richardson ..... 702/9
4,916,617 A * 4/1990 Norwood ..... 702/13
5,132,904 A * 7/1992 Lamp ..... 700/282
5,415,030 A 5/1995 Jogi et al.
5,419,405 A * 5/1995 Patton ..... 175/27
5,983,164 A * 11/1999 Ocondi ..... 702/12
6,021,377 A 2/2000 Dubinsky et al.
6,101,445 A * 8/2000 Alvarado et al. ..... 702/9
6,408,953 B1 6/2002 Goldman et al.
6,519,568 B1 * 2/2003 Harvey et al. ..... 705/1.1
6,578,634 B2 * 6/2003 Newman ..... 166/250.01
6,675,101 B1 * 1/2004 Shray et al. ..... 702/6
6,728,638 B2 * 4/2004 Newman ..... 702/5
6,826,492 B2 * 11/2004 Newman ..... 702/45

(Continued)

FOREIGN PATENT DOCUMENTS

CA 2373576 A1 12/2000
CA 2457078 A1 8/2004

(Continued)

OTHER PUBLICATIONS

Murray et al, "Risk Mitigation Technique for Advanced Rig Control Systems", IADC/SPE Middle East Drilling Technology, (IADC/SPE 72329), Oct. 22-24, 2001.

(Continued)

*Primary Examiner* — Jennifer H Gay
(74) *Attorney, Agent, or Firm* — Katten Muchin Rosenman LLP

(57) ABSTRACT

A system for directing the drilling of a well at a drill-site includes an instructing unit, an instructed unit, and a central unit. The instructed unit receives drilling instruction from an instructing driller, sends drilling instructions to the central unit, and presents to the instructing driller drilling instructions and instruction confirmations received from the central unit. The instructed unit receives instruction confirmations from an instructed driller, sends instruction confirmations to the central unit, and presents to the instructed driller drilling instructions received from the central unit. The central unit stores and forwards drilling instructions and instruction confirmations to the instructing unit and instructed unit, and generates and stores slide sheet information from the drilling instructions.

19 Claims, 1 Drawing Sheet

U.S. PATENT DOCUMENTS

| | | | | |
|---|---|---|---|---|
| 6,843,120 | B2 | 1/2005 | Standen | |
| 6,968,909 | B2 | 11/2005 | Aldred et al. | |
| 7,006,009 | B2 * | 2/2006 | Newman | 340/854.5 |
| 7,142,986 | B2 | 11/2006 | Moran | |
| 7,243,027 | B2 * | 7/2007 | Ireland et al. | 702/6 |
| 7,264,050 | B2 * | 9/2007 | Koithan et al. | 166/250.15 |
| 2002/0156582 | A1 * | 10/2002 | Newman | 702/5 |
| 2002/0156591 | A1 * | 10/2002 | Newman | 702/45 |
| 2002/0156670 | A1 * | 10/2002 | Newman | 705/9 |
| 2002/0156730 | A1 * | 10/2002 | Newman | 705/40 |
| 2004/0065440 | A1 | 4/2004 | Farabee et al. | |
| 2004/0217879 | A1 * | 11/2004 | Guggari et al. | 340/853.3 |
| 2005/0161260 | A1 | 7/2005 | Koithan et al. | |
| 2007/0284147 | A1 | 12/2007 | Moran | |
| 2010/0127888 | A1 * | 5/2010 | He et al. | 340/853.2 |
| 2011/0155461 | A1 * | 6/2011 | Hutniak et al. | 175/24 |
| 2011/0155463 | A1 * | 6/2011 | Khromov et al. | 175/45 |
| 2011/0174541 | A1 * | 7/2011 | Strachan et al. | 175/27 |

FOREIGN PATENT DOCUMENTS

| | | | |
|---|---|---|---|
| EP | 0 572 055 | A1 | 5/1992 |
| WO | 02/25319 | A2 | 3/2002 |
| WO | 03/071091 | A1 | 8/2003 |
| WO | 2009/058635 | A2 | 5/2009 |

OTHER PUBLICATIONS

Levitt, "Improved Safety of Rig Automation with Remote Monitoring and Diagnostics", The Seventh SPE International Conference on Health, Safety, and Environment in oil and Gas Exploration and Production, Mar. 29-31 2004 (SPE 86600).

* cited by examiner

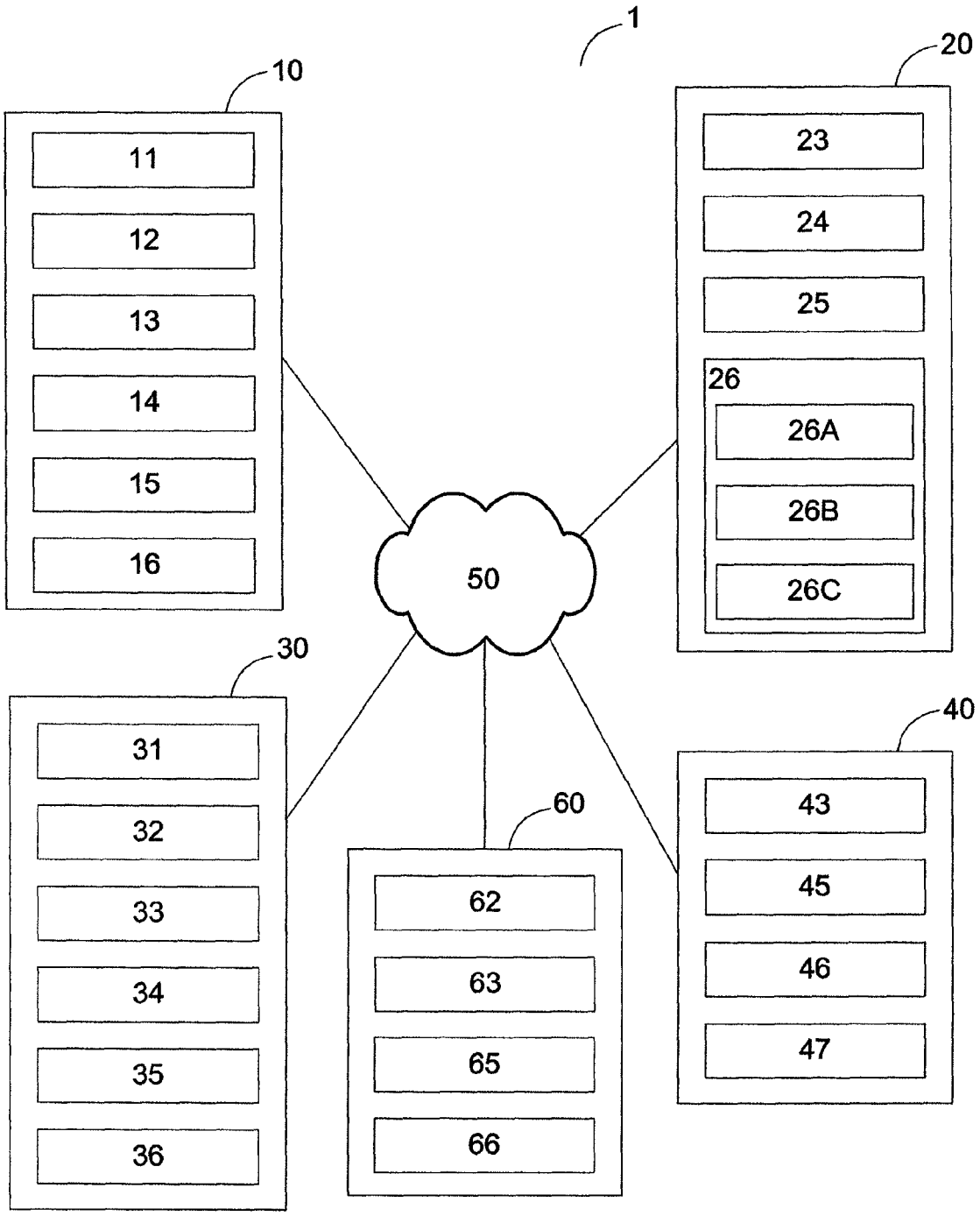
1
10
11
12
13
14
15
16
20
23
24
25
26
26A
26B
26C
50
30
31
32
33
34
35
36
60
62
63
65
66
40
43
45
46
47

SYSTEM AND APPARATUS FOR DIRECTING THE DRILLING OF A WELL

FIELD OF INVENTION

The present invention relates to a system and apparatus for directing the drilling of a well at a drill-site.

BACKGROUND OF THE INVENTION

Drilling operations involve numerous specialized workers located at a drill-site. Typically, at least one worker (the "instructing driller") is tasked with directing the drilling of the well by monitoring the path of the well and instructing one or more workers ("instructed drillers") to make adjustments to the drilling equipment such that the path of the well closely follows a predetermined well plan.

The instructing driller is located at the drill-site and communicates instructions to the instructed drillers by either using an on-site phone, being physically located on the drilling floor to speak to the instructed drillers, or using an electronic note on an Electronic Drilling Recorder (EDR).

The instructing driller is responsible for recording all instructions issued by the instructing driller into a document known as a slide sheet. The slide sheet is a record of the actions taken at a drill-site during the drilling of a well. The instructing driller manually enters information into the slide sheet either as a paper record or as a digital record.

In directional drilling applications, the well plan identifies a series of target points through which the path of well is desired to follow. The instructing driller directs the path of the well by communicating instructions to the instructed drillers to control the advancement of a drill string into the ground. The drill string comprises a bottom hole assembly ("BHA") positioned at the bottom most point of the drill string, and a series of drill pipes (also known as "singles") that are incrementally attached to the upper tail end of the drill string as the drill string advances into the ground. The BHA typically comprises a drill bit, a mud motor, a bent sub, a measurement while drilling ("MWD") tool, and other components that are well known in the art.

The instructing driller monitors the path of well by interpolating the results of periodic surveys taken during the drilling operation. Each survey identifies the current depth, inclination and azimuth of the BHA. The instructing driller controls the path of the well by issuing drilling instructions to the instructed drillers that typically comprise a combination of one or more slide and rotate commands. A slide command directs the instructed drillers to advance the drill string a specific distance and at a specific toolface angle without rotation of the drill string. A rotate command directs the instructed drillers to advance the drill string a specific distance while rotating the drill string.

SUMMARY OF THE INVENTION

The present invention provides, in part, a system and apparatus for directing the drilling of a well at a drill-site.

In accordance with one embodiment, a system for directing the drilling of a well at a drill-site is provided, comprising:

(a) an instructing unit communicatively coupled with a central unit, the instructing unit configured to receive one or more drilling instructions from an instructing driller, send received drilling instructions to the central unit, receive one or more instruction confirmations from the central unit, and present received instruction confirmations to the instructing driller;

(b) an instructed unit located at the drill-site and communicatively coupled with the central unit, the instructed unit configured to receive one or more instruction confirmations from an instructed driller, send received instruction confirmations to the central unit, receive one or more drilling instructions from the central unit, and present received drilling instructions to the instructed driller;

(c) a central unit communicatively coupled with the instructing unit and instructed unit, comprising:

(i) a receiver configured to receive one or more drilling instructions from the instructing unit and one or more instruction confirmations from the instructed unit;

(ii) a memory having stored therein a data structure for storing received drilling instructions, received instruction confirmations, and slide sheet information;

(iii) a logger communicatively coupled to the receiver and the memory, the logger configured to store received drilling instructions and received instruction confirmations in the memory;

(iv) a slide sheet manager communicatively coupled to the receiver and the memory, the slide sheet manager configured to generate slide sheet information from the received drilling instructions and store the slide sheet information in the memory; and (v) a transmitter communicatively coupled to the receiver, the transmitter configured to transmit received drilling instructions to the instructed unit and received instruction confirmations to the instructing unit.

The instructing unit may be located remote to the drill-site.

The system may further comprise a plurality of instructing units.

The system may further comprise an alarm unit located at the drill-site, the alarm unit configured to receive an alarm instruction from the central unit and generate an audible alarm upon receipt of the alarm instruction; the central unit may further comprise an alarm manager communicatively coupled to the receiver, the alarm manager selectively configurable to issue the alarm instruction upon receipt of one or more drilling instructions by the receiver of the central unit; and the transmitter of the central unit may further be configured to transmit the alarm instruction issued by the alarm manager to the alarm unit.

The system may further comprise a monitoring unit communicatively coupled with the central unit, the monitoring unit configured to receive one or more drilling instructions and instruction confirmations from the central unit, and present received drilling instructions and instruction confirmations to a user; and the transmitter of the central unit may be further configured to transmit received drilling instructions and received instruction confirmations to the monitoring unit.

The system may comprise a plurality of monitoring units.

The instructing unit may be further configured to receive slide sheet information from the central unit and present slide sheet information to the instructing driller; and the transmitter of the central unit may be further communicatively coupled to the slide sheet manager and may be further configured to transmit slide sheet information to the instructing unit.

The instructed unit may be further configured to receive slide sheet information from the central unit and present slide sheet information to the instructed driller; and the transmitter of the central unit may be further configured to transmit slide sheet information to the instructed unit.

The instructing unit may be further configured to receive drilling instructions from the central unit and present received drilling instructions to the instructing driller; and the transmitter of the central unit may be further configured to transmit received drilling instructions to the instructing unit.

The instructed unit may be further configured to receive instruction confirmations from the central unit and present received instruction confirmations to the instructed driller; and the transmitter of the central unit may be further configured to transmit received instruction confirmations to the instructed unit.

The monitoring unit may be further configured to receive slide sheet information from the central unit and present slide sheet information to the user; and the transmitter of the central unit may be further communicatively coupled to the slide sheet manager and may be further configured to transmit slide sheet information to the monitoring unit.

In accordance with one embodiment, an apparatus for facilitating the drilling of a well at a drill-site is provided, the apparatus comprising:

(a) a receiver configured to receive one or more drilling instructions from an instructing unit and one or more instruction confirmations from an instructed unit;

(b) a memory having stored therein a data structure for storing received drilling instructions, received instruction confirmations, and slide sheet information;

(c) a logger communicatively coupled to the receiver and the memory, the logger configured to store received drilling instructions and received instruction confirmations in the memory;

(d) a slide sheet manager communicatively coupled to the receiver and the memory, the slide sheet manager configured to generate slide sheet information from the received drilling instructions and store the slide sheet information in the memory; and (e) a transmitter communicatively coupled to the receiver, the transmitter configured to transmit received drilling instructions to the instructed unit and received instruction confirmations to the instructing unit.

The apparatus may further comprise an alarm manager communicatively coupled to the receiver, the alarm manager selectively configured to issue an alarm instruction upon receipt of one or more drilling instructions by the receiver; and the transmitter may be further configured to transmit the alarm instruction issued by the alarm manager to an alarm unit located at the drill-site.

The transmitter may be further configured to transmit received drilling instructions and received instruction confirmations to a monitoring unit.

The transmitter may be further configured to transmit slide sheet information to the instructing unit.

The transmitter may be further communicatively coupled to the slide sheet manager and may be further configured to transmit slide sheet information to the instructed unit.

The transmitter may be further communicatively coupled to the slide sheet manager and may be further configured to transmit slide sheet information to the monitoring unit.

The transmitter may be further configured to transmit received drilling instructions to the instructing unit.

The transmitter may be further configured to transmit received instruction confirmations to the instructed unit.

BRIEF DESCRIPTION OF THE DRAWINGS

FIG. 1 is a system diagram of a system for directing the drilling of a well according to one embodiment of the invention.

DETAILED DESCRIPTION OF EMBODIMENTS OF THE INVENTION

The embodiments described herein relate to a system and apparatus for directing the drilling of a directional well at a drill-site. Particularly, the embodiments relate to a system and apparatus for communicating drilling instructions from one or more instructing drillers to one or more instructed drillers, providing feedback to instructing drillers by communicating confirmations of the receipt of drilling instructions by the instructed drillers (referred to as "instruction confirmations"), logging communications from the instructing drillers and instructed drillers, and updating and maintaining a slide sheet respecting the drilling of the well. While the embodiments described herein relate to directional drilling applications, it is to be understood that the scope of the present invention is not limited to directional drilling applications and is equally applicable to other drilling applications.

The term "communicatively coupled" as used herein "communicatively coupled" refers to communication between two devices and/or components, directly or through one or more intermediate devices and/or components, including without limitation, communication through one or more systems, networks, buffers, databases, or media.

Further, throughout the specification, where a "computer" is referenced it may include one or more computers located at one more locations communicating through one or more networks. Where a "processor" is referenced it may include one or more processors located at one more locations communicating through one or more networks, including without limitation, application specific circuits, programmable logic controllers, field programmable gate arrays, microcontrollers, microprocessors, virtual machines, electronic circuits and other processing devices known in the art. Where a "computer readable medium" or "memory" is referenced it may include one or more computer readable mediums located at one more locations communicating through one or more networks, including without limitation, random access memory, flash memory, hard disc drives, read-write optical drives and optical drive media, flash drives, and other computer readable storage media known in the art. Where a "network" is referenced it may include one or more networks, including without limitation, local area networks, wide area networks, intranets, the Internet, and other networks known in the art.

Referring to FIG. 1, a first embodiment of a system for directing the drilling of a directional well at a drill-site is shown generally as item 1 and is comprised of the following major components: an instructing unit 10, a central unit 20, an instructed unit 30, an alarm unit 40, a monitoring unit 60 and a network 50. Alternatively, the system 1 may comprise a plurality of instructing units having the functionality of the instructing unit 10 described herein. In the further alternative, the system 1 may comprise a plurality of monitoring units having the functionality of the monitoring unit 60 described herein.

The Instructing Unit

The instructing unit 10 (a) receives drilling instructions from the instructing driller and drilling information from the central unit 20, (b) forwards drilling instructions to the central unit 20, and (c) presents drilling information to the instructing driller. The instructing unit 10 is located remote to the drill-site, thereby protecting the instructing driller from the potentially hazardous environment at the drill-site. Alternatively, the instructing unit 10 may be located at the drill-site if desired.

The instructing unit 10 is integrated with a directional drilling monitoring system (not shown) that provides the instructing driller with information pertaining to the drilling operation, such as, survey data, environmental conditions, well plan, pressure data, MWD decoder data, toolface information and configuration settings. Alternatively, the instructing unit 10 may be a standalone unit or integrated with other drilling equipment.

The instructing unit 10 comprises: an input device 11, a display 12, a receiver 13, a transmitter 14, a memory 15, and a processor 16. The input device 11 receives drilling instructions input by an instructing driller. The input device 11 consists of a keyboard, mouse and graphical display. Alternatively, the input device 11 may be comprised of any electronic device or combination of electronic devices known in the art for receiving information from a user.

The drilling instructions describe specific actions for the instructed drillers to follow at the drill-site. The drilling instructions are selected from one of the instructions in the following table resulting in the following corresponding actions taken by the instructed drillers. Alternatively, the drilling instructions may consist of any action or combination of actions that an instructing driller may desire the instructed drillers to follow at the drill-site.

| Instruction | Action |
|---|---|
| Slide and Rotate | Advance the drill string without rotation by a first distance at a specified tool face angle and then rotate and advance the drill string by a second distance. |
| Rotate and Slide | Rotate and advance the drill string by a first distance and then advance the drill string without rotation by a second distance at a specified tool face angle. |
| Slide | Advance the drill string without rotation by a specified distance at a specified tool face angle. |
| Rotate | Rotate and advance the drill string by a specified distance. |
| Cancel | Cancel the previously issued instruction. |
| Stop Drilling | Stop all drilling activity and await new instruction. |

For the "Slide and Rotate", "Rotate and Slide" and "Slide" instructions, the toolface angle is specified with respect to either magnetic north ("MAG") or the top of the well ("GRAN").

The receiver 13 receives drilling information sent by the central unit 20 over the network 50 to the instructing unit 10. The receiver 13 comprises an Ethernet receiver that communicatively coupled with the central unit 20 over the network 50 to receive drilling instructions, instruction confirmations and slide sheet information. Alternatively, the receiver 13 may consist of other communications hardware employing a variety of communications protocols as are well known in the art.

The display 12 is a computer monitor or other type of graphical electronic display that presents drilling information to the instructing drillers that is received from the central unit 20 by the receiver 13, such as, drilling instructions, instruction confirmations and slide sheet information.

The transmitter 14 transmits drilling instructions to the central unit 20. The transmitter 14 comprises an Ethernet transmitter that is communicatively coupled with the central unit 20 over the network 50. Alternatively, the transmitter 14 may comprise other communications hardware employing a variety of communications protocols as are well known in the art.

The memory 15 comprises a computer readable medium having statements and instructions stored thereon that when executed by the processor 16 provide the functionality of the instructing unit 10 as described below.

The processor 16 is communicatively coupled to the display 12, the receiver 13, the transmitter 14, and the memory 15. The processor 16 executes the statements and instructions stored in the memory 15 to: (a) receive drilling instructions from the instructing driller and drilling information from the central unit 20, (b) forward drilling instructions to the central unit 20, and (c) present drilling information to the instructing driller. Specifically, the processor 16 unpackages each communication received from the central unit 20 by the receiver 13 from its packaged form, and directs the display 12 to present drilling information to the instructing driller, such as, drilling instructions, instruction confirmations and slide sheet information. In the present embodiment, each communication is unpackaged from its packaged form conforming to the applicable communication protocols, decompressed using a decompression utility such as GZIP™, and converted from an Extensible Markup Language ("XML") data object into the unpackaged drilling information.

The processor 16 also packages each drilling instruction received by the input device 11 from the instructing driller into a form suitable for transmission over the network 50, and directs the transmitter 12 to transmit the packaged drilling instruction to the central unit 20. In the present embodiment, each drilling instruction is converted into a XML data object, compressed using a compression utility such as GZIP™, and packaged to conform to the applicable communication protocols.

The Instructed Unit

The instructed unit 30 is located at the drill-site and functions to: (a) receive instruction confirmations from the instructed drillers and drilling information from the central unit 20, (b) forward instruction confirmations to the central unit 20, and (c) present drilling information to the instructed drillers.

The instructed unit 30 is a Pason Systems Corp. Sidekick. Alternatively, the instructed unit 30 may be a standalone unit or integrated with other drilling equipment.

The instructed unit 30 comprises: an input device 31, a display 32, a receiver 33, a transmitter 34, a memory 35, and a processor 36. The input device 31 functions to receive instruction confirmations input by the instructed drillers. The input device 31 consists of a touchscreen. Alternatively, the input device 31 may be comprised of any electronic device or combination of electronic devices known in the art for receiving information from a user.

The instruction confirmations provide feedback to the instructing driller indicating that a drilling instruction has been received by the instructed drillers. An instruction confirmation may be issued for each drilling instruction received by the instructed unit 30, except for a "Cancel" instruction. Alternatively, an instruction confirmation may be issued in response to the receipt of one or more drilling instructions.

The receiver 33 receives drilling information sent by the central unit 20 over the network 50 to the instructed unit 30. The receiver 33 comprises an Ethernet receiver that is communicatively coupled with the central unit 20 over network 50 to receive drilling instructions, instruction confirmations and slide sheet information. Alternatively, the receiver 33 may comprise other communications hardware employing a variety of communications protocols as are well known in the art.

The display 32 is a computer monitor or other type of graphical electronic display that presents drilling information to the instructed drillers that is received from the central unit 20 by the receiver 33, such as, drilling instructions, instruction confirmations and slide sheet information.

The transmitter 34 transmits the instruction confirmations to the central unit 20. The transmitter 34 comprises an Ethernet transmitter that is communicatively coupled with the central unit 20 over the network 50. Alternatively, the transmitter 34 may comprise other communications hardware employing a variety of communications protocols as are well known in the art.

The memory 35 comprises a computer readable medium having statements and instructions stored thereon that when executed by the processor 36 provide the functionality of the instructed unit 30 as described below.

The processor 36 is communicatively coupled to the display 32, the receiver 33, the transmitter 34, and the memory 35. The processor 36 executes the statements and instructions stored in the memory 34 to: (a) receive instruction confirmations from the instructed drillers and drilling information from the central unit 20, (b) forward instruction confirmations to the central unit 20, and (c) present drilling information to the instructed drillers. Specifically, the processor 36 unpackages each communication received from the central unit 20 by the receiver 33 from its packaged form, and directs the display 32 to present drilling information to the instructed drillers, such as, drilling instructions, instruction confirmations and slide sheet information. In the present embodiment, each communication is unpackaged from its packaged form conforming to the applicable communication protocols, decompressed using a decompression utility such as GZIP™, and converted from an Extensible Markup Language ("XML") data object into the unpackaged drilling information.

The processor 36 also packages each instruction confirmation received by the input device 31 from the instructed drillers into a form suitable for transmission over the network 50, and directs the transmitter 32 to transmit the packaged instruction confirmation to the central unit 20. In the present embodiment, each instruction confirmation is converted into a XML data object, compressed using a compression utility such as GZIP™, and packaged to conform to the applicable communication protocols.

The Alarm Unit

The alarm unit 40 is located at the drill-site and functions to generate an audible alarm upon receipt of an alarm instruction from the central unit 20. The audible alarm indicates to the instructed drillers at the drill-site that a new drilling instruction has been sent by the central unit 20 to the instructed unit 30.

The alarm unit 40 is a Pason Systems Corp. Pit Volume Totalizer. Alternatively, the instructed unit 30 may be a standalone unit or integrated with other drilling equipment.

The alarm unit 40 comprises a receiver 43, a memory 45, a processor 46, and an alarm transducer 47. The receiver 43 receives alarm instructions sent by the central unit 20 over the network 50 to the alarm unit 40. The receiver 43 comprises an Ethernet receiver. Alternatively, the receiver 41 may comprise other communications hardware employing a variety of communications protocols as are well known in the art.

The alarm transducer 47 generates an audible alarm directed at the instructed drillers at the drill-site to indicate that a new drilling instruction has been sent to the instructed unit 30.

The memory 45 comprises a computer readable medium having statements and instructions stored thereon that when executed by the processor 46 provide the functionality of the alarm unit 40 as described below.

The processor 46 is communicatively coupled to the receiver 43, the memory 15, and the alarm transducer 47. The processor 46 executes the statements and instructions stored in the memory 44 to generate an audible alarm upon receipt of an alarm instruction from the central unit 20. Specifically, the processor 46 unpackages each communication received from the central unit 20 by the receiver 43 from its packaged form, and directs the alarm transducer 47 to generate an audible alarm. In the present embodiment, each communication is unpackaged from its packaged form conforming to the applicable communication protocols, decompressed using a decompression utility such as GZIP™, and converted from an Extensible Markup Language ("XML") data object into the unpackaged alarm instruction.

The Monitoring Unit

The monitoring unit 60 is located remote to the drill-site. Alternatively, the monitoring unit 60 may be located at the drill-site if desired. The monitoring unit 60 functions to receive drilling information from the central unit 20 and present received drilling information to a user.

The monitoring unit 60 is a standalone unit comprised of a general-purpose computer. Alternatively, the monitoring unit 60 may be integrated with other drilling equipment.

The monitoring unit 60 comprises a display 62, a receiver 63, a memory 65, and a processor 66. The receiver 63 receives drilling information sent by the central unit 20 over the network 50 to the monitoring unit 60. The receiver 63 comprises an Ethernet receiver that is communicatively coupled with the central unit 20 over the network 50 to receive drilling instructions, instruction confirmations and slide sheet information. Alternatively, the receiver 63 may consist of other communications hardware employing a variety of communications protocols as are well known in the art.

The display 62 is a computer monitor or other type of graphical electronic display that presents drilling information to the user that is received from the central unit 20 by the receiver 63, such as, drilling instructions, instruction confirmations and slide sheet information.

The memory 65 comprises a computer readable medium having statements and instructions stored thereon that when executed by the processor 66 provide the functionality of the monitoring unit 60 as described below.

The processor 66 is communicatively coupled to the display 62, the receiver 63, and the memory 65. The processor 66 executes the statements and instructions stored in the memory 64 to receive drilling information from the central unit 20 and present received drilling information to a user. Specifically, the processor 66 unpackages each communication received from the central unit 20 by the receiver 63 from its packaged form, and directs the display 63 to present drilling information to the user, such as, drilling instructions, instruction confirmations and slide sheet information. In the present embodiment, each communication is unpackaged from its packaged form conforming to the applicable communication protocols, decompressed using a decompression utility such as GZIP™, and converted from an Extensible Markup Language ("XML") data object into the unpackaged drilling information.

The Central Unit

The central unit 20 functions to: (a) receive drilling instructions from the instructing unit 10 and instruction confirmations from the instructed unit 30; (b) automatically and accurately store a history of all received drilling instructions and confirmation instructions; (c) automatically and accurately update and maintain a slide sheet for the drilling operation; (d) transmit drilling information to the instructing unit 10, instructed unit 30, and monitoring unit 60; and (e) selectively transmit alarm instructions to the alarm unit 40. The central unit 20 is located at the drill-site. Alternatively, the central unit 20 may be located remote to the drill-site if desired.

The central unit 20 is a standalone unit comprised of a general-purpose computer. Alternatively, the central unit 20 may be integrated with other drilling equipment.

The central unit 20 comprises: a receiver 23, a transmitter 24, a memory 25, and a processor 26. The receiver 23 receives drilling information sent by the instructing unit 10 and instructed unit 30 to the central unit 20. The receiver 23 comprises an Ethernet receiver that is communicatively coupled with the instructing unit 10 and instructed unit 30 over the network 50 to receive drilling instructions from the instructing unit 10 and instruction confirmations from the instructed unit 30. Alternatively, the receiver 23 may comprise other communications hardware employing a variety of communications protocols as are well known in the art.

The transmitter 24 is communicatively coupled to the instructing unit 10, the instructed unit 30, the monitoring unit 60, and the alarm unit 40. The transmitter 24 comprises an Ethernet transmitter that is communicatively coupled with the instructing unit 10, instructed unit 30 and monitoring unit 60 over the network 50. Alternatively, the transmitter 26 may comprise other communications hardware employing a variety of communications protocols as are well known in the art.

The memory 25 comprises a computer readable medium having statements and instructions stored thereon that when executed by the processor 26 provide the functionality of the central unit 20 as described below. The memory 25 also comprises a data structure stored therein for storing drilling information. In the present embodiment, the data structure is a database configured to store drilling instructions received from the instructing unit 10, instruction confirmations received from the instructed unit 30, and slide sheet information generated by the central unit 20.

The processor 26 is communicatively coupled to the receiver 23, the transmitter 24, and the memory 25. The processor 26 executes the statements and instructions stored in the memory 25 to: (a) receive drilling instructions from the instructing unit 10 and instruction confirmations from the instructed unit 30; (b) automatically and accurately store a history of all received drilling instructions and confirmation instructions; (c) automatically and accurately update and maintain a slide sheet for the drilling operation; (d) transmit drilling information to the instructing unit 10, instructed unit 30, and monitoring unit 60; and (e) selectively transmit alarm instructions to the alarm unit 40.

The processor 26 unpackages each communication received from the instruction unit 10 and instructed unit 30 from its packaged form and provides the functionality of a logger 26A, slide sheet manager 26B, and an alarm manager 26C as further described below. In the present embodiment, each communication is unpackaged from its packaged form conforming to the applicable communication protocols, decompressed using a decompression utility such as GZIP™, and converted from a XML data object into the unpackaged drilling information.

The processor 26 executes instructions and statements stored in the memory 25 that define a logger 26A. The logger 26A automatically and accurately stores all drilling instructions received from the instructing unit 10 and all instruction confirmations received from the instructed unit 30 to the memory 25.

The processor 26 also executes instructions and statements stored in the memory 25 that define a slide sheet manager 26B. The slide sheet manager 26B accurately and automatically updates and maintains the slide sheet information stored in the memory 25 to account for each "Slide and Rotate", "Rotate and Slide", "Slide" and "Rotate" drilling instruction received from the instructing unit 10. The slide sheet manager 26B generates slide sheet information for each of these drilling instructions received by the central unit 20 and stores the slide sheet information in the memory 25. Slide sheet information is generated by copying the drilling instruction, modifying the copied drilling instruction to account for the current depth of the drill string, and converting the modified drilling instruction into the format of a slide sheet entry. For example, if the current depth of the drill string is 1000 meters, the current drill pipe is 9.45 meters long, and the drilling instruction "Slide and Rotate 5 m@48° MAG" is received by the central unit 20, then the slide sheet manager 26B will store the following slide sheet entry in the slide sheet:

| Slide From | Slide To | Toolface | Rotate From | Rotate To |
|---|---|---|---|---|
| 1000.0 m | 1005.0 m | 48° MAG | 1005.0 m | 1009.45 m |

Upon receipt of a "Cancel" instruction from the instructing unit 10, the slide sheet manager 26B removes the slide sheet entry pertaining to the last drilling instruction received from the instructing unit 10. No action is taken by the slide sheet manager 26B upon receipt of a "Stop Drilling" instruction from the instructing unit 10.

The processor 26 also executes instructions and statements stored in the memory 25 that define an alarm manager 26C. The alarm manager 26C selectively issues an alarm instruction directed to the alarm unit 40 for each drilling instruction sent by the central unit 20 to the instructed unit 30. The alarm manager 26C is selectively configurable to either issue an alarm instruction or not issue an alarm instruction for each drilling instruction sent to the instructed unit 30 by the central unit 20. Alternatively, the alarm manager 26C may issue an alarm instructed upon the receipt of one or more drilling instructions sent to the instructed unit 30 by the central unit 20.

The processor 26 packages and drilling information received or generated by the central unit 20 into a form suitable for transmission over the network 50. In the present embodiment, the drilling information is converted into a XML data object, compressed using a compression utility such as GZIP™, and packaged to conform to the applicable communication protocols. The processor 26 then transmits the packaged drilling information as follows: (a) drilling instructions received from the instructing unit 10 are transmitted to the instructing unit 10, instructed unit 30, and monitoring unit 60; (b) confirmation instructions received from the instructed unit 30 are transmitted to the instructing unit 10, instructed unit 30, and monitoring unit 60; (c) slide sheet information generated by the slide sheet manager 26B is transmitted to the instructing unit 10, instructed unit 30, and monitoring unit 60; and (d) alarm instructions issued by the alarm manager 26C are transmitted to the alarm unit 40.

The Network

The network 50 comprises a Local Area Network ("LAN") at the drill-site and a satellite connection for off-site communications. At the drill-site, the central unit 20 is communicatively coupled with the instructed unit 30 and alarm unit 40 over an Ethernet-based Local Area Network (LAN). The instructing unit 10 and monitoring unit 60 located remote to the drill-site are communicatively coupled with the central unit 20 located at the drill-site through a satellite connection. Alternatively, the instructing unit 10, central unit 20, instructed unit 30, alarm unit 40 and monitoring unit 60 may be communicatively coupled through any combination of networks utilizing any combination of communication mediums and protocols know in the art.

System Operation

In operation, the instructing driller monitors the status of the drilling operation and path of the well from a location remote to the drill-site. When the instructing driller desires the instructed drillers to take a specific action, the instructing driller inputs a drilling instruction to the input device 11 of the instructing unit 10. The transmitter 14 of the instructing unit 10 then packages the drilling instruction as described above and transmits the packaged drilling instruction to the central unit 20 over the network 50.

The receiver 21 of the central unit 20 receives the packaged drilling instruction sent from the instructing unit 10 which is unpackaged by the processor 26. In response to the received drilling instruction: the logger 26A stores the unpackaged drilling instruction to the memory 25, the slide sheet manager 26B converts the unpackaged drilling instruction to slide sheet information and stores the slide sheet information to the memory 25, and the alarm manager 26C issues an alarm instruction if it has been selectively configured to do so. The processor 26 packages the drilling instruction, slide sheet information and alarm instruction, and the transmitter 26 transmits over the network 50 the packaged drilling instruction and slide sheet information to the instructing unit 10, instructed unit 30 and monitoring unit 60, and the packaged alarm instruction to the alarm unit 40.

The receiver 13 of the instructing unit 10 receives the packaged drilling instruction and slide sheet information sent from the central unit 20. The processor 16 unpackages the drilling instruction and slide sheet information and the display 12 presents the unpackaged drilling instruction and slide sheet information to the instructing driller. The instructing driller may also optionally view the slide sheet information on the display 12 if desired.

The receiver 33 of the instructed unit 30 also receives the packaged drilling instruction and slide sheet information sent from the central unit 20. The processor 36 unpackages the drilling instruction and slide sheet information and the display 32 presents the unpackaged drilling instruction and slide sheet information to the instructed drillers. The instructed drillers may also optionally view the slide sheet information on the display 32 if desired.

The receiver 63 of the monitoring unit 60 also receives the packaged drilling instruction and slide sheet information sent from the central unit 20. The processor 66 unpackages the drilling instruction and slide sheet information and the display 62 presents the unpackaged drilling instruction and slide sheet information to the user. The user may also optionally view the slide sheet information on the display 62 if desired.

The receiver 43 of the alarm unit 40 receives the packaged alarm instruction sent from the central unit 20. The processor 46 unpackages the alarm instruction and the alarm transducer 47 generates an audible alarm directed at the instructed drillers at the drill-site.

After the instructed drillers have reviewed the drilling instruction presented on the display 32 of the instructed unit 30, the instructed drillers input an instruction confirmation to the input device 31. The processor 36 then packages the instruction confirmation and the transmitter 34 transmits the instruction confirmation to the central unit 20.

The receiver 21 of the central unit 20 receives the packaged instruction confirmation sent from the instructed unit 30. In response to the received instruction confirmation: the processor unpackages the instruction confirmation, the logger 26A stores the unpackaged instruction confirmation to the memory 25, the processor packages the instruction confirmation, and the transmitter 26 transmits the packaged instruction confirmation over the network 50 to the instructing unit 10, instructed unit 30 and monitoring unit 60.

The receiver 13 of the instructing unit 10 receives the packaged instruction confirmation sent from the central unit 20. The processor 16 then unpackages the instruction confirmation and the display 12 visually presents the unpacked instruction confirmation to the instructing driller.

The receiver 33 of the instructed unit 30 also receives the packaged instruction confirmation sent from the central unit 20. The processor 36 then unpackages the instruction confirmation and the display 32 visually presents the unpacked instruction confirmation to the instructed drillers.

The receiver 63 of the monitoring unit 60 also receives the packaged instruction confirmation sent from the central unit 20. The processor 66 then unpackages the instruction confirmation and the display 62 visually presents the unpacked instruction confirmation to the user.

The drilling of the well continues as the directional driller issues additional drilling instructions to direct the path of the well to conform with the predefined well plan.

While a particular embodiment of the present invention has been described in the foregoing, it is to be understood that other embodiments are possible within the scope of the invention and are intended to be included herein. It will be clear to any person skilled in the art that modifications of and adjustments to this invention, not shown, are possible without departing from the spirit of the invention as demonstrated through the exemplary embodiment.

The invention claimed is:

1. A system for directing the drilling of a well at a drill-site, comprising:

(a) an instructing unit communicatively coupled with a central unit, the instructing unit configured to receive one or more drilling instructions from an instructing driller, send received drilling instructions to the central unit, receive one or more instruction confirmations from the central unit, and present received instruction confirmations to the instructing driller;

(b) an instructed unit located at the drill-site and communicatively coupled with the central unit, the instructed unit configured to receive one or more instruction confirmations from an instructed driller, send received instruction confirmations to the central unit, receive one or more drilling instructions from the central unit, and present received drilling instructions to the instructed driller; and wherein (c) the central unit is communicatively coupled with the instructing unit and instructed unit, and comprises:

(i) a receiver configured to receive one or more drilling instructions from the instructing unit and one or more instruction confirmations from the instructed unit;

(ii) a memory having stored therein a data structure for storing received drilling instructions, received instruction confirmations, and slide sheet information;

(iii) a logger communicatively coupled to the receiver and the memory, the logger configured to store received drilling instructions and received instruction confirmations in the memory;

(iv) a slide sheet manager communicatively coupled to the receiver and the memory, the slide sheet manager configured to generate slide sheet information from the received drilling instructions and store the slide sheet information in the memory; and (v) a transmitter communicatively coupled to the receiver, the transmitter configured to transmit received drilling instructions to the instructed unit and received instruction confirmations to the instructing unit.

2. The system in claim 1, wherein the instructing unit is located remote to the drill-site.

3. The system in claim 1, further comprising a plurality of instructing units.

4. The system in claim 1, wherein:

(a) the system further comprises an alarm unit located at the drill-site, the alarm unit configured to receive an alarm instruction from the central unit and generate an audible alarm upon receipt of the alarm instruction;

(b) the central unit further comprises an alarm manager communicatively coupled to the receiver, the alarm manager selectively configurable to issue the alarm instruction upon receipt of one or more drilling instructions by the receiver of the central unit; and (c) the transmitter of the central unit is further configured to transmit the alarm instruction issued by the alarm manager to the alarm unit.

5. The system in claim 1, wherein:

(a) the system further comprises a monitoring unit communicatively coupled with the central unit, the monitoring unit configured to receive one or more drilling instructions and instruction confirmations from the central unit, and present received drilling instructions and instruction confirmations to a user;

(b) the transmitter of the central unit is further configured to transmit received drilling instructions and received instruction confirmations to the monitoring unit.

6. The system in claim 5, wherein the system comprises a plurality of monitoring units.

7. The system in claim 5, wherein:

(a) the monitoring unit is further configured to receive slide sheet information from the central unit and present slide sheet information to the user; and (b) the transmitter of the central unit is further communicatively coupled to the slide sheet manager and is further configured to transmit slide sheet information to the monitoring unit.

8. The system in claim 1, wherein:

(a) the instructing unit is further configured to receive slide sheet information from the central unit and present slide sheet information to the instructing driller; and (b) the transmitter of the central unit is further communicatively coupled to the slide sheet manager and is further configured to transmit slide sheet information to the instructing unit.

9. The system in claim 8, wherein:

(a) the instructed unit is further configured to receive slide sheet information from the central unit and present slide sheet information to the instructed driller; and (b) the transmitter of the central unit is further configured to transmit slide sheet information to the instructed unit.

10. The system in claim 1, wherein:

(a) the instructing unit is further configured to receive drilling instructions from the central unit and present received drilling instructions to the instructing driller; and (b) the transmitter of the central unit is further configured to transmit received drilling instructions to the instructing unit.

11. The system in claim 10, wherein:

(a) the instructed unit is further configured to receive instruction confirmations from the central unit and present received instruction confirmations to the instructed driller; and (b) the transmitter of the central unit is further configured to transmit received instruction confirmations to the instructed unit.

12. An apparatus for facilitating the drilling of a well at a drill-site, the apparatus comprising:

(a) a receiver configured to receive one or more drilling instructions from an instructing unit and one or more instruction confirmations from an instructed unit;

(b) a memory having stored therein a data structure for storing received drilling instructions, received instruction confirmations, and slide sheet information;

(c) a logger communicatively coupled to the receiver and the memory, the logger configured to store received drilling instructions and received instruction confirmations in the memory;

(d) a slide sheet manager communicatively coupled to the receiver and the memory, the slide sheet manager configured to generate slide sheet information from the received drilling instructions and store the slide sheet information in the memory; and (e) a transmitter communicatively coupled to the receiver, the transmitter configured to transmit received drilling instructions to the instructed unit and received instruction confirmations to the instructing unit.

13. The apparatus in claim 12, wherein:

(a) the apparatus further comprises an alarm manager communicatively coupled to the receiver, the alarm manager selectively configured to issue an alarm instruction upon receipt of one or more drilling instructions by the receiver; and (b) the transmitter is further configured to transmit the alarm instruction issued by the alarm manager to an alarm unit located at the drill-site.

14. The apparatus in claim 12, wherein the transmitter is further configured to transmit received drilling instructions and received instruction confirmations to a monitoring unit.

15. The apparatus in claim 14, wherein the transmitter is further communicatively coupled to the slide sheet manager and is further configured to transmit slide sheet information to the monitoring unit.

16. The apparatus in claim 12, wherein the transmitter is further configured to transmit slide sheet information to the instructing unit.

17. The apparatus in claim 16, wherein the transmitter is further communicatively coupled to the slide sheet manager and is further configured to transmit slide sheet information to the instructed unit.

18. The apparatus in claim 12, wherein the transmitter is further configured to transmit received drilling instructions to the instructing unit.

19. The apparatus in claim 18, wherein the transmitter is further configured to transmit received instruction confirmations to the instructed unit.

* * * * *